United States Patent [19]

Lape

[11] 3,972,683

[45] Aug. 3, 1976

[54] FLUID TRANSFER APPARATUS

[75] Inventor: Larry J. Lape, Sugarland, Tex.

[73] Assignee: Hycel, Inc., Houston, Tex.

[22] Filed: June 7, 1974

[21] Appl. No.: 477,425

[52] U.S. Cl. ..... 23/259; 23/253 R; 73/425.6; 141/258; 222/249

[51] Int. Cl.[2] ..... B01L 3/02

[58] Field of Search ..... 23/253 R, 259; 141/26, 141/27, 258, 259, 260, 261, 262; 222/249, 253; 73/425.6; 134/8

[56] References Cited

UNITED STATES PATENTS

| | | | |
|---|---|---|---|
| 3,047,367 | 7/1962 | Kessler | 23/253 R X |
| 3,484,170 | 12/1969 | Smythe et al. | 23/253 R X |
| 3,572,998 | 3/1971 | Anthon | 23/253 R X |
| 3,630,683 | 12/1971 | Robb | 23/253 R X |
| 3,716,338 | 2/1973 | Moran | 23/253 R X |
| 3,728,079 | 4/1973 | Moran | 23/259 X |
| 3,825,443 | 7/1974 | Reilly | 134/8 X |

*Primary Examiner*—Joseph Scovronek
*Assistant Examiner*—Arnold Turk
*Attorney, Agent, or Firm*—Timothy L. Burgess; Robert P. Cogan

[57] ABSTRACT

There is disclosed apparatus for aspirating and dispensing a liquid sample which includes a storage cylinder within which is included a freely moving solid cylinder. Attached to the storage cylinder is an aspirating cylinder or needle, which is inserted into the sample. Both the storage cylinder and needle are initially filled with water. Before aspirating the sample, a slight amount of water is removed from the storage cylinder resulting in air being aspirated through the needle. Then, the needle is inserted in the sample and water continues to be removed from the storage cylinder, resulting in the sample being aspirated through the needle. The aspirated sample and water are separated by the previously aspirated air, which creates a bubble in the storage cylinder. This bubble lifts the movable solid cylinder in the storage cylinder as the sample is aspirated. After a desired amount of sample is aspirated, discrete amounts of water are added to the storage cylinder, thereby causing discrete amounts of sample to be dispensed through the needle. The water pressure on the solid cylinder resting against the bubble expands the bubble against the inner surface of the storage cylinder, thereby creating a separation between the water and the sample.

14 Claims, 6 Drawing Figures

FLUID TRANSFER APPARATUS

This invention relates to liquid aspirating and dispensing apparatus and more particularly to such apparatus for use with an automatic chemical testing apparatus.

In recent years, the techniques of performing blood tests have become more and more automated, as illustrated by U.S. Pat. No. 3,622,279 entitled "Automatic Chemical Testing Apparatus" and U.S. Pat. No. 3,716,338 entitled "Sample Fluid Dispensing Apparatus For Chemical Testing Apparatus", divided from U.S. Pat. No. 3,622,279, both of which patents are in the name of John J. Moran and assigned to the present assignee. According to the teaching of these patents, blood serum, placed in a sample container, is aspirated by a serum aspirating and dispensing unit, which unit is then physically moved, measured amounts of the aspirated serum are dispensed into a series of test tubes. The apparatus of these patents are designed so that it is possible to select the number of different tests (from one to a specified maximum) which are to be performed and the amount of serum aspirated depends upon the number of tests selected. Thus, when a low number of tests is selected, a smaller amount of serum is aspirated into aspirating and dispensing unit than is the situation when a larger number of tests is selected.

In the serum aspirating and dispensing unit of the referenced patents, a water filled conduit, connected to a water filled line, is inserted into the serum, and water is removed from the line, thereby aspirating serum into the conduit and line. The removal of the water begins occurring just prior to the time the conduit is inserted into the serum, and thus, a slight amount of air is aspirated and forms a bubble in the line which separates the water from the subsequently aspirated serum.

It has been found that this bubble, separating the serum and water, does not totally prevent water from mixing with and diluting the serum which has been aspirated into the line. The amount of dilution will be proportional to the time the serum remains in the line, which is, in turn proportional to the number of tests selected to be performed. The effect of this dilution can be removed, in part, by proper calibration, but the problem still remains. It naturally would be better to eliminate the problem of dilution, or at least to reduce it to be within the entire system error.

In accordance with one preferred embodiment of this invention, there is provided apparatus for aspirating a liquid sample contained in a sample container which comprises a conduit having first and second ends and a solidly shaped member movable in an end to end direction within the conduit. There is also provided the means for moving the first end of the conduit into the sample. The conduit is filled with a liquid prior to the time the means for moving the conduit begins to move it. There additionally is provided operative means coupled to the conduit for hydraulically moving liquid from the first to the second end of the conduit between a first and second time. The first time is prior to the time the conduit is moved into the sample, and the second time is after the conduit is moved into the sample.

A more detailed description of a preferred embodiment of this invention is hereafter described, with specific reference being made to the following figures in which.

Figure 1:
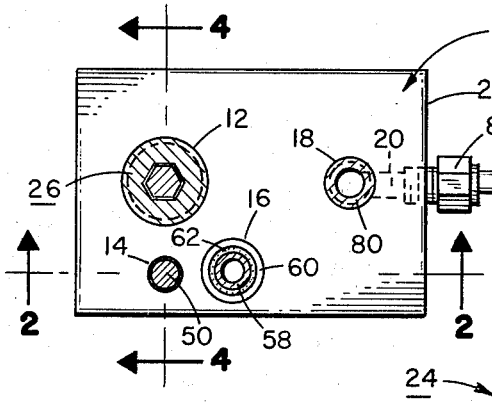
FIG. 1 is a top view of a base for holding various components of the serum aspirating and dispensing unit apparatus of this invention.

Referring now to FIG. 1, a base 10 is shown upon which is affixed various elements used in serum aspirating and dispensing unit of this invention. On base 10 are drilled a series of holes 12,14,16,18 and 20. Holes 12,14 and 16 are drilled entirely through base 10. Hole 18 is drilled partly through base 10 and hole 20 is drilled from the side 22 of base 10 into hole 18.

Figure 2:
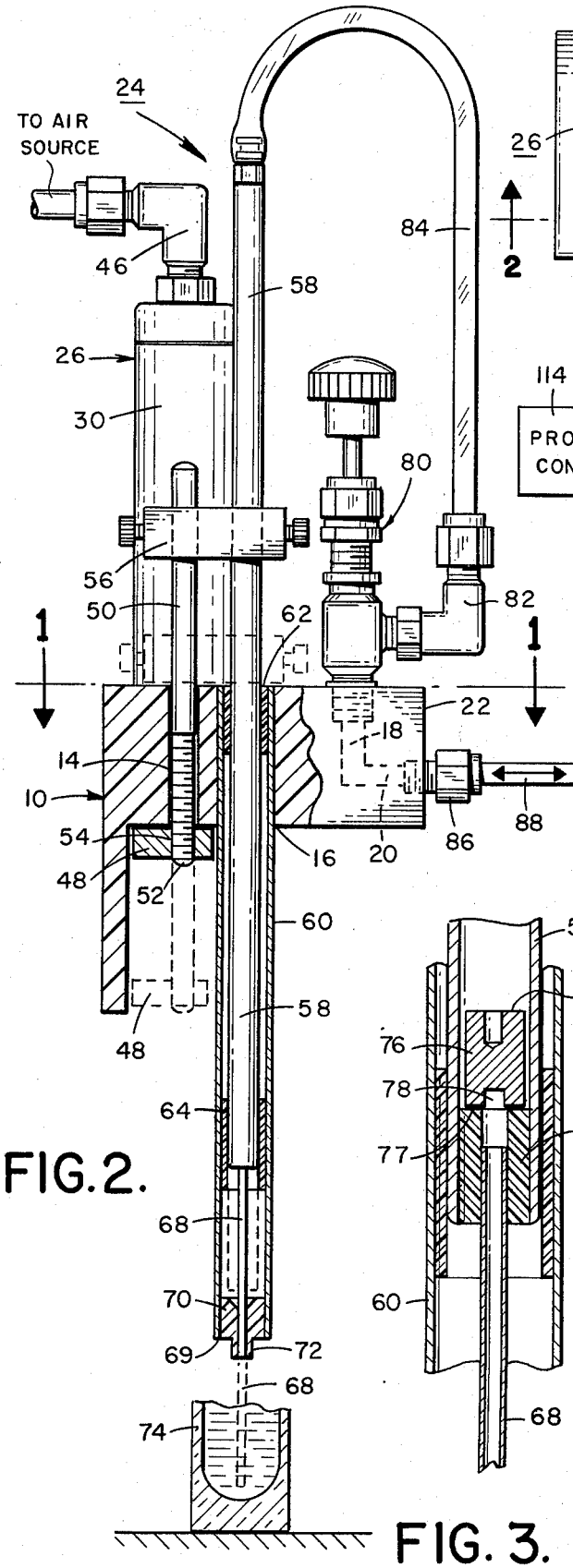
FIG. 2 is a cross-sectional view taken across line 2—2 of FIG. 1 further showing some of the components of the serum aspirating and dispensing unit of this invention.
Figure 4:
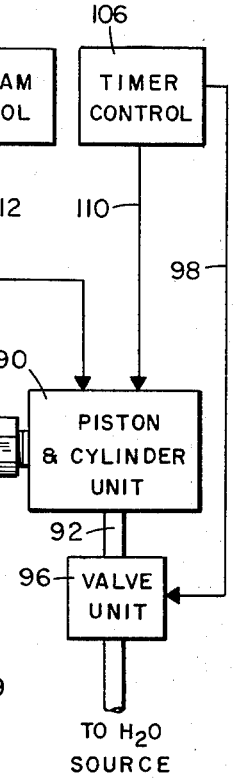
FIG. 4 is a cross-sectional view taken across line 4—4 of FIG. 1 further showing some of the components of the serum aspirating and dispensing unit of this invention.
Figure 4:
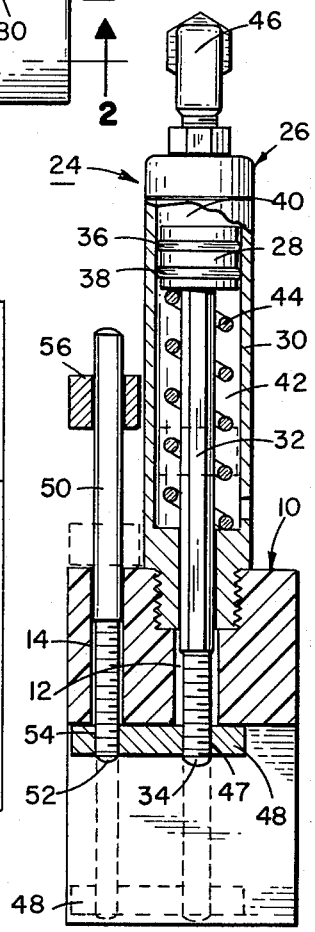
Figure 3:
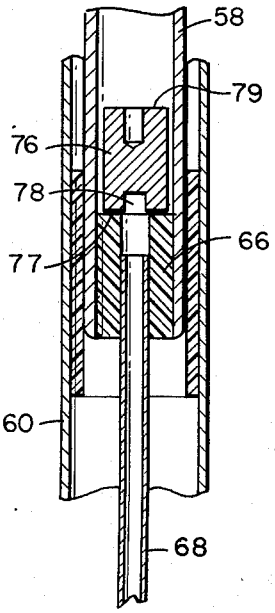
FIG. 3 is a larger view of a portion of FIG. 2.

Referring now to FIGS. 2, 3 and 4, serum aspirating and dispensing unit 24 will now be explained. It should be noted that in each of the FIGS. 1 through 6, like numerical designations are used for like elements. Positioned above and through hole 12 on base 10 is an air-actuated, spring-return piston and cylinder assembly 26. Assembly 26 includes a piston 28 and cylinder 30. Piston 28 includes a stem 32 extending therefrom having a threaded end 34.

Piston 28 has a pair of O-rings 36 and 38 associated therewith and O-rings 36 and 38 and piston 28 separate assembly 26 into an air chamber 40 and a spring chamber 42. Spring chamber 42 contains a compressible spring 44, which when compressed, places upward pressure on the lower end of piston 28. When air pressure from a pressure source (not shown) is applied to air chamber 40 through connector 46, the pressure applied to piston 28 forces piston 28 in a downward direction, thereby forcing stem 32 in a downward direction to the position shown by the dashed lines. When the air pressure through connector 46 is released, spring 44 forces piston 28 upward to the position shown by the solid lines.

The threaded end 34 of stem 32 is secured in a threaded hole 47 of bracket 48, which moves with stem 32 as piston 28 moves. A rod 50 is inserted through hole 14 and a threaded end 52 thereof is secured in a second threaded hole 54 in bracket 48. A bracket 56 connects rod 50 to a storage cylinder 58, so that when rod 50 moves, storage cylinder 58 moves with it. When air is introduced into the air chamber 40 of assembly 26, piston 28 moves in a downward direction causing bracket 48 to move down thereby pulling rod 50 down. As rod 50 moves down, it pulls bracket 56 down, which in turn moves storage cylinder 58 down. The downward position of the elements 28, 32, 48, 50, 56 and 58, are shown by the dashed lines in FIGS. 2 and 4.

A protective cylinder 60 is firmly affixed in hole 16 and extends downward from the base 10. The inside diameter of protective cylinder 60 is larger than the outside diameter of storage cylinder 58 so that storage cylinder 58 can move within protective cylinder 60. Storage cylinder 58 is maintained in axial movement by guides 62 and 64, which may be hollow cylinders, made of nonstick material, such as Teflon, which are inserted within protective cylinder 60 and have inside diameters such that storage cylinder 58 may move therethrough.

At the lower portion of storage cylinder 58, a connecting cylinder 66 made of a nonstick material, such as Teflon, is firmly inserted within storage cylinder 58. The diameter of the inner surface of connecting cylinder 66 is such that a narrow aspirating cylinder 68 may be firmly inserted therein. Aspirating cylinder 68 extends from connecting cylinder 66 through hollow cylindrical guide 70, which is firmly inserted into the end 69 of protective cylinder 60. Guide 70 is made of nonstick material, such as Teflon, and has an extension 72 therefrom surrounding the inside surface of guide 70, through which aspirating cylinder 68 moves. Extension 72 wipes away any liquid remaining on the outer surface of aspirating cylinder 68.

As storage cylinder 58 is caused to move downward by the previously explained action of air cylinder 26, bracket 48, rod 50 and bracket 56, aspirating cylinder 68 moves downward from extension 72. At the time this happens, unit 24 will have been physically moved so that aspirating cylinder 68 is in alignment with a serum container 74, which contains the serum sample to be tested. When aspirating cylinder 68 is fully extended, it will be near the bottom of serum container 74, as shown by the dashed lines.

Within storage cylinder 58 is a separating cylinder 76, which may be solid shaped member having an outer diameter less than the inner diameter of storage cylinder 58, whereby it is free to move within storage cylinder 58 from a point above connecting cylinder 66. It has been found that a difference between the inner diameter of storage cylinder 58 and the outer diameter of separating cylinder 76 of six thousandths of an inch is a sufficient difference for good operation of the embodiment herein described. On the end 77 of separating cylinder 76 closest to connecting cylinder 66, a notch 78 has been removed from separating cylinder 76. The presence of notch 78 in separating cylinder 76 allows water in storage cylinder 58 to flow between the outer surface of separating cylinder 76 and the inner surface of storage cylinder 58 through notch 78 to connecting cylinder 66 and then into aspirating cylinder 68 in order to wash any aspirated serum sample from storage cylinder 58. The other side 79 of separating cylinder 76 has a hole drilled therein to make the weight of separating cylinder 76 lighter, but not at the expense of decreasing the length thereof. A valve 80 is secured into hole 18 of base 10. A piece of plastic tubing 84 connects the output end 82 of valve 80 to storage cylinder 58. One end of a connector 86 is secured into hole 20 in base 10, and the other end of connector 86 is connected to a piece of plastic tubing 88. The other end of tubing 88 is connected to the output side of piston and cylinder control unit 90. Tubing 92 connects input side of unit 90 to the output of valve unit 96, which may be turned on and off by an appropriate signal on line 98 from timer control circuit 106. The input of valve unit 96 is coupled to a water supply source.

When valve unit 96 is open by the appropriate signal on line 98, water flows through valve unit 96, tubing 92, unit 90, tubing 88, connector 86 into holes 20 and 18 and out through valve 80 and tubing 84 into storage cylinder 58. The flow of this water then flows through storage cylinder 58 and around separating cylinder 76 and through notch 78 and into aspirating cylinder 68 as previously explained. It should be noted that the lower surface of separating cylinder 76 is forced into contact with the upper surface of connecting cylinder 66 by the water pressure.

This water flow is used to cleanse the inside of storage cylinder 58 and aspirating cylinder 68 so that when a new sample of serum is aspirated from container 74, the sample previously aspirated will not mix with, or contaminate, this aspirated sample. Further, this flow of water causes the entire hydraulic system to be primed, or in other words, filled with water. It should be noted that at the time this cleansing action is occurring the entire unit 24 will have been physically moved to be in alignment with a waste receptacle, rather than in alignment with sample container 74, as is shown in the U.S. Pat. Nos. 3,622,279 and 3,716,338.

Piston and cylinder unit 90 may be turned on by an electrical signal applied thereto on line 110 from timer control circuit 106. Piston and cylinder unit 90 is used to aspirate an amount of serum from sample container 74, which amount depends upon the number of tests selected. The piston and cylinder unit 90 dispenses precise amounts of aspirated serum into the testing containers (not shown) after unit 24 is physically moved to a position where aspirating cylinder 68 is in alignment with the testing container, in a manner more fully described in the referenced patents. Within piston and cylinder unit 90 may be included a known type of ratchet or gearing assembly, which is under the control of the signal on line 112 and which will allow the piston to move a precise amount, thereby dispensing a corresponding precise amount of sample desired for a selected test. Such a gearing assembly is explained in more detail in the referenced patents.

The operation of apparatus 24 will now be explained. After valve unit 96 is turned on and then turned off, the entire hydraulic system, including the inside of aspirating cylinder 68, storage cylinder 58, tubing 84, valve 80, holes 18 and 20, connector 86 and tubings 88 and 92 will be filled with water. At this point, unit 24 is physically moved so that aspirating cylinder 68 is in alignment with serum container 74. Then, air pressure is applied through connector 46 to force piston 28 in assembly 26 to begin moving downward. As previously explained, this causes aspirating cylinder 68 to move downward into the serum contained in serum container 74.

Prior to aspirating cylinder 68 actually contacting and becoming immersed in the serum in serum container 74, signals on lines 110 and 112 cause the piston in piston and cylinder unit 90 to begin moving backward, thereby aspirating some air through aspirating cylinder 68. At this point, aspirating cylinder 68 becomes immersed in the serum in serum container 74 and serum is aspirated into aspirating cylinder 68 and storage cylinder 58. Because air had previously been aspirated, an air bubble is formed which separates the aspirated serum and the previously existing water within storage cylinder 58. This bubble forces separating cylinder 76 to move upward as the bubble between the water and the serum moves in an upward direction in storage cylinder 58 due to the aspiration. After a sufficient amount of serum has been aspirated through aspirating cylinder 68 and stored in storage cylinder 58, unit 24 is physically moved so that aspirating cylinder 68 is in alignment with the first one of the testing containers (not shown) in which an actual test may be performed.

If the first test is to be performed, serum is dispensed into the first testing container, as a result of program control circuit 114 causing a signal to appear on line 112, which causes the piston in piston and cylinder unit 90 to move downward a preset amount as determined by the internal gearing in unit 90. This causes the serum closest to aspirating cylinder 68 to be dispensed into that particular testing container. This process continues for each of the testing containers in which a test is to be run as the unit 24 is physically moved from one testing container to the next testing container.

After all of the serum has been dispensed into the desired testing container, unit 24 is again physically moved to the wash receptacle (not shown) and valve unit 96 is open by a signal appearing on line 98 and water is flushed through the hydraulic system in the manner previously explained. At this point, the system is ready to aspirate the next serum sample and unit 24 is again physically moved so aspirating cylinder 68 is in alignment with a new serum container 74.

Figure 5:
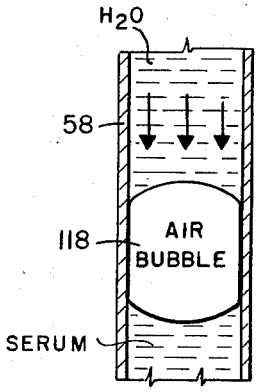
FIG. 5 shows the manner by which the water and the serum are separated according to the teachings of the prior art.
Figure 6:
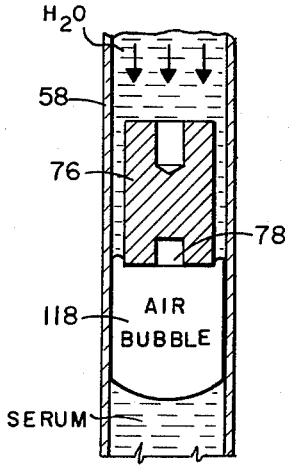
FIG. 6 shows the manner by which the water and the serum are separated according to the teachings of the present invention.

Referring now to FIGS. 5 and 6, the operation of the separating cylinder 76, and air bubble will be explained. FIG. 5 shows a prior art system in which no separating cylinder 76 is used and is useful in understanding the problem with the prior art. FIG. 6 shows a similar system having a separating cylinder 76 therein and is useful in understanding of the present invention over the prior art system.

In FIG. 5, where no separating cylinder 76 exists, the air bubble 118 has a meniscus at both the top and the bottom. This meniscus results in a weak point in the air bubble 118 along the inner surface of storage cylinder 58. This weak point, in turn, allows water from above the bubble 118 to seep along the inner surface of storage cylinder 58 and mix with the serum below air bubble 118, thereby diluting that portion of the serum nearest to air bubble 118.

As seen in FIG. 6, the force of separating cylinder 76 resting on air bubble 118 depresses the meniscus downward, thereby tending to expand air bubble 118 towards the inner surface of storage cylinder 58. This, in turn, results in air bubble 118 acting as a much better separation between the serum and the water in storage cylinder 58. Thus, very little, if any, water is allowed to flow around air bubble 118 and mix with the serum.

What is claimed is:

1. Apparatus for aspirating a liquid sample contained in a sample container comprising:

a conduit having first and second ends;

a solid member movable within said conduit towards said second end thereof;

means for moving said first end of said conduit into said sample;

said conduit being filled with a liquid prior to the time said means for moving begins to move said conduit; and operative means coupled to said conduit for hydraulically moving liquid from said first towards said second end of said conduit between a first and a second time, said first time being prior to the time said conduit is moved into said sample and said second time being after said conduit is moved into said sample;

whereby an air bubble is formed to separate said liquid and said sample, said solid member resting upon and moving with said bubble as said bubble moves towards said second end with the moving liquid, thereby causing said bubble to expand to prevent the mixing of said liquid and sample.

2. The invention according to claim 1 wherein said conduit and said solid member are cylindrical.

3. The invention according to claim 1:

wherein said conduit comprises a storage conduit, an aspirating conduit having an inside dimension less than that of said storage conduit, and connection means forming a fluid communication connection between said storage conduit and said aspirating conduit, the end of said aspirating conduit remote from said connection means being said first end, and the end of said storage conduit remote from said connection means being said second end; and wherein said solid member is movable within said storage conduit only.

4. The invention according to claim 3:

wherein said operative means adds liquid to said second end at a third time after said second time, said added liquid being greater, by volume, than said removed liquid, and wherein said solid member includes a slot therein on the end thereof closest to said connection to allow said liquid to pass through said connection and through said aspirating conduit when said solid member comes in contact with said connection.

5. The invention according to claim 3:

wherein each of said storage conduit and aspirating conduit are hollow cylinders, and said solid member is a closed cylinder having an outside diameter less than the inside diameter of said storage conduit and greater than the inside diameter of said aspirating conduit.

6. The invention according to claim 5:

wherein said solid member has a slot in the end thereof closest to said connection;

wherein said operating means includes means for adding, under pressure, discrete amounts of liquid to said second end after a desired amount of liquid is removed therefrom to cause said sample to be dispensed from said first end, said solid member putting force on said air bubble in a direction from said second end towards said first end to cause said air bubble to expand towards the inside surface of said storage cylinder, and maintaining an interface between said liquid and said sample; and wherein said means included in said operating means adds more liquid to said second end than the amount of liquid previously removed to force said member to contact said connection, said excess liquid added flowing between said solid member outer cylindrical surface and said storage conduit inner cylindrical surface, through said slot and through said aspirating conduit to remove all sample remaining therein and to refill said storage and aspirating conduits with said liquid.

7. The invention according to claim 6 wherein said solid member has a hole partially therethrough from said surface remote from said connection.

8. In an automatic chemical testing apparatus including a container holding a liquid sample to be tested, a plurality of testing containers into which specific amounts of said sample are to be dispensed for subsequent testing, and an assembly including sample aspirating and dispensing means for aspirating sample through an aspirating conduit from said sample container and dispensing said aspirated sample through said conduit into at least one testing container, said assembly further including means for moving said sample aspirating and dispensing means between a position so that said conduit is in alignment with said sample container and a position so that said conduit is in alignment with said one testing container, the improvement in said sample aspirating and dispensing means comprising;

a liquid filled line;

means for hydraulically moving said liquid through said line;

sample storage means connecting said liquid filled line and said first aspirating conduit, said sample storage means including a second conduit and a solid member movable within said second conduit;

means for moving said first conduit into said sample at the time said first conduit is in alignment with said sample container, and for moving said first conduit out of said sample container after a predetermined amount of said sample has been aspirated;

said hydraulic moving means moving said liquid in said liquid filled line towards said second and first conduits prior to a time said first conduit is in alignment with said sample container so that said first and second conduits are filled with said liquid, and moving said liquid in said liquid filled line away from said first and second conduits from a time after said first conduit moving means begins moving said first conduit towards said sample container and before the time said first conduit contacts said sample in said sample container and until a time after said first conduit is in said sample;

whereby said sample is aspirated into said first and second conduits, and an air bubble is formed between said liquid and aspirated sample, said movable member resting upon and moving with said bubble as said bubble moves above said aspirated sample, thereby causing said bubble to expand to prevent the mixing of said liquid and sample.

9. The invention according to claim 8 wherein said second conduit is a hollow cylinder and said solid member included therein is a closed cylinder.

10. The invention according to claim 9:

wherein said sample aspirating and dispensing means further includes connecting means connecting said first and second conduits so that fluid can flow between said first and second conduits; and wherein said solid member has a slot in the surface thereof closest to said connecting means, said slot being positioned to allow liquid to flow between said solid member and said second conduit, through said slot and into said first conduit.

11. The invention according to claim 10 wherein said solid member has a hole partially extending therein from the surface thereof remote from said connection.

12. Apparatus for dispensing a stored liquid sample into a container comprising:

a conduit having an input end and an output end;

a solid member movable in an end to end direction within said conduit;

said liquid sample being stored in said conduit at the output end portion of said conduit and a driving liquid being stored at the input end portion of said conduit, said liquid sample and driving liquid being separated by an air bubble upon which rests said solid member, thereby causing said bubble to expand to prevent the mixing of said sample and said driving liquid; and means for adding precise amounts of driving liquid to said input end.

13. The invention according to claim 12 wherein said conduit and said solid member are cylindrical.

14. The invention according to claim 13 wherein said adding means, after adding said precise amounts of driving liquid, adds an amount of driving liquid sufficient to purge said conduit of all remaining liquid sample;

wherein said conduit includes stop means for stopping said solid member during said addition of said purging amount of driving liquid; and wherein said solid member includes a slot thereon on the end thereof closest to said output end to allow said driving liquid to pass around said solid member and stop means and out said output end of said conduit.

* * * * *